US009905968B2

(12) United States Patent
Yanase et al.

(10) Patent No.: US 9,905,968 B2
(45) Date of Patent: Feb. 27, 2018

(54) COAXIAL CONNECTOR WITH FLOATING MECHANISM

(71) Applicant: SMK Corporation, Tokyo (JP)

(72) Inventors: Tomoyasu Yanase, Tokyo (JP); Kiyoshi Asai, Kanagawa (JP); Fumio Osawa, Tokyo (JP); Manabu Dobashi, Tokyo (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 15/335,450

(22) Filed: Oct. 27, 2016

(65) Prior Publication Data

US 2017/0047683 A1 Feb. 16, 2017

Related U.S. Application Data

(63) Continuation of application No. PCT/JP2015/084864, filed on Dec. 7, 2015.

(30) Foreign Application Priority Data

Aug. 4, 2015 (JP) ..... 2015-154172

(51) Int. Cl.

| | |
|---|---|
| ***H01R 13/64*** | (2006.01) |
| ***H01R 13/631*** | (2006.01) |
| *H01R 103/00* | (2006.01) |
| *H01R 24/54* | (2011.01) |

(52) U.S. Cl.

CPC ..... *H01R 13/6315* (2013.01); *H01R 24/542* (2013.01); *H01R 2103/00* (2013.01)

(58) Field of Classification Search

CPC .. H01R 13/6315; H01R 13/631; H01R 13/74; H01R 13/11; H01R 2103/00

USPC ..... 439/246–249

See application file for complete search history.

(56) References Cited

U.S. PATENT DOCUMENTS

| | | | | |
|---|---|---|---|---|
| 4,227,765 | A * | 10/1980 | Neumann | H01R 24/52 439/248 |
| 4,580,862 | A * | 4/1986 | Johnson | H01R 13/6315 439/248 |
| 4,697,859 | A * | 10/1987 | Fisher, Jr. | H01R 13/6315 439/246 |
| 4,808,115 | A * | 2/1989 | Norton | G02B 6/381 361/721 |
| 5,516,303 | A | 5/1996 | Yohn et al. | |

(Continued)

FOREIGN PATENT DOCUMENTS

| | | | |
|---|---|---|---|
| JP | H8-236227 | A | 9/1996 |
| JP | 2007-87682 | A | 4/2007 |

OTHER PUBLICATIONS

International Search Report for International Application No. PCT/JP2015/084864, issued by the Japan Patent Office dated Mar. 8, 2016.

*Primary Examiner* — Hien Vu

(57) ABSTRACT

In a coaxial connector with a floating mechanism, a housing of a socket includes a housing base portion and a housing movable portion which can move radially over a plug-side end face of the housing base portion with a socket-side center contact. A top side of a plug-side shell is fitted onto the housing movable portion. A socket-side shell integrally includes shell contact plate portions which are exposed from the plug-side end face of the housing base portion. An end of the plug-side shell is configured to come into contact with the shell contact plate portions.

6 Claims, 17 Drawing Sheets

(56) References Cited

U.S. PATENT DOCUMENTS

| | | | | |
|---|---|---|---|---|
| 6,224,407 | B1 * | 5/2001 | Duquerroy ..... | H01R 13/6315<br>439/188 |
| 7,422,456 | B1 | 9/2008 | Mitani et al. | |
| 8,465,311 | B2 * | 6/2013 | Takamatsu ..... | G02B 6/3821<br>439/247 |

* cited by examiner

COAXIAL CONNECTOR WITH FLOATING MECHANISM

CROSS REFERENCE TO RELATED APPLICATION

The contents of the following Japanese patent application and international application are incorporated herein by reference, Japanese Patent Application No. 2015-154172 filed on Aug. 4, 2015, and International Application No. PCT/JP2015/84864 filed on Dec. 7, 2015.

FIELD

The present invention relates to a coaxial connector that is used in connecting an electronic device and a coaxial cable, connecting electronic devices, etc. In particular, the present invention relates to a coaxial connector with a floating mechanism which provides excellent connectability between a plug and a socket.

BACKGROUND

A socket of a coaxial connector of this type includes a socket-side center contact which is arranged at the center of the socket, and a socket-side shell which is arranged outside the socket-side center contact. If the socket is connected with a plug, the socket-side center contact and the socket-side shell both need to be appropriately connected with a plug-side center contact and a plug-side shell of the counterpart.

Depending on the mounting positions of the socket and the plug with respect to support members such as a substrate and a chassis built in an electronic device, axial and radial positional deviations may occur between the socket and the plug to be connected with each other. In connecting the coaxial connectors, such positional deviations need to be corrected.

A socket with a floating mechanism has thus been used as a socket of a related coaxial connector (for example, see Patent Literature 1). The socket with a floating mechanism includes a socket main body which is movably supported in radial directions (x- and y-axis directions) with respect to a socket base portion. The socket main body is connected with a plug. The socket base portion is fixed to a support member such as a substrate and a casing.

The socket base portion includes a socket-side shell of cylindrical shape, a center conductor portion, an insulating member, and biasing means such as a coil spring and a disc spring. The socket-side shell movably holds the socket main body. The center conductor portion is arranged at the center of and within the socket-side shell. The insulating member insulates the center conductor portion from the socket-side shell. The biasing means radially bias the socket main body held by the socket-side shell. With such a configuration, the socket main body and the coaxial connector of the counterpart can be connected to each other even if axially misaligned.

CITATION LIST

Patent Literature

Patent Literature 1: Japanese Patent Application Laid-Open No. 2008-262736

SUMMARY

Technical Problem

A coaxial connector of this type is desired to correct not only a positional deviation in the radial directions (x- and y-axis directions) but also a positional deviation in the axial direction (z-axis direction) if the plug and the socket are supported by respective different support members and the support members are assembled into a set.

However, related coaxial connectors with a floating mechanism are often configured to allow movement of the socket main body with respect to the socket base portion in only the radial directions (x and y directions). For a positional deviation in the axial direction (z-axis direction), somewhat large connection tolerance or the like is set between the plug and socket. The absorption of the positional deviation in the axial direction may produce an axial gap between the plug-side shell and the socket-side shell, which can degrade performance and affect the shielding characteristic.

According to the related technique described in Patent Literature 1, the socket main body which is interconnected with the coaxial connector of the counterpart and the socket base portion which movably holds the socket main body are separately provided. Thus, there has been a problem that the external shape of the entire socket becomes accordingly greater, hampering miniaturization.

Related techniques such as described in Patent Literature 1 need a coil spring or disc spring for biasing the socket main body in the axial or radial directions. Thus, there has been a problem that the parts count increases accordingly, causing an increase in the product cost and the manufacturing steps.

Moreover, in this type of related coaxial connector with a floating mechanism, the center contact of the socket main body and the center conductor of the socket base portion are separately formed, and the socket main body is configured to be radially movable with respect to the socket base portion. This needs a structure for movably and electrically connecting the center contact and the center conductor to each other. There has thus been a problem of a complicated structure.

High-frequency performance is important to the coaxial connector of this type. If the center contact moves together with the socket main body to cause an axial misalignment between the center contact and the center conductor of the socket base portion, the high-frequency performance may drop.

Solution to Problem

In view of such conventional problems, the present invention has been achieved to provide a coaxial connector with a floating mechanism which can maintain high high-frequency performance and floating performance, has less parts count, and is capable of miniaturization.

To solve the foregoing conventional problems and achieve the intended object, a first aspect of the invention provides a coaxial connector with a floating mechanism, including a plug and a socket to be connected to each other, the plug including a plug-side center contact that is arranged at a center, a plug-side shell that is arranged outside the plug-side center contact, and a plug-side insulator that is interposed between the plug-side center contact and the plug-side shell, the socket including a socket-side center contact that is arranged at a center, a socket-side shell that is arranged outside the socket-side center contact, and a housing that holds the socket-side center contact and the socket-side shell in a mutually insulated state, the housing including a housing base portion that is fixed to a support member, and a housing movable portion that is radially movable over a plug-side end face of the housing base portion along with the socket-side center contact, a top side of the plug-side shell being fitted onto the housing movable portion, wherein the socket-side shell integrally includes a shell contact plate portion that is exposed from the plug-side end face of the housing base portion, and an end of the plug-side shell is configured to make contact with the shell contact plate portion.

A second aspect of the invention is characterized, in addition to the configuration of the first aspect, by that a contact plate escape groove is circumferentially formed in the housing movable portion, and the shell contact plate portion is configured to be able to escape into the contact plate escape groove.

A third aspect of the invention is characterized, in addition to the configuration of the first or second aspect, by that a sliding contact portion of arc-like chamfered shape is formed on the end of the plug-side shell.

A fourth aspect of the invention is characterized, in addition to the configuration of any one of the first to third aspects, by that the plug-side shell includes a shell main body that holds the plug-side insulator, a movable shell of cylindrical shape that is axially movably held on a socket side of the shell main body, and a biasing spring that biases the movable shell to the socket side.

A fifth aspect of the invention is characterized, in addition to the configuration of any one of the first to fourth aspects, by that the housing includes a floating spring member that is fixed at one end to the housing base portion and at the other end to the housing movable portion, and the floating spring member includes a support fixed portion that is fixed to the housing base portion, a floating fixed portion that is fixed to the housing movable portion, and an elastically-deformable swing spring portion that connects the support fixed portion and the floating fixed portion, and the housing movable portion is movably supported by the housing base portion via the floating spring member.

A sixth aspect of the invention is characterized, in addition to the configuration of the fifth aspect, by that the socket-side center contact includes a contact portion that moves together with the housing movable portion, and a substrate connection terminal that is connected to a mounting substrate, the contact portion is integrally supported by the floating fixed portion of the floating spring member, the substrate connection terminal is integrally supported with the support fixed portion, and the socket-side center contact is integrated with the floating spring member.

A seventh aspect of the invention is characterized, in addition to the configuration of the fifth or sixth aspect, by that the socket-side shell includes a pair of elastic contact pieces that are opposed to each other at a distance in a direction crossing a direction from the support fixed portion to the floating fixed portion, the pair of elastic contact pieces being arranged outside the housing movable portions.

An eighth aspect of the invention is characterized, in addition to the configuration of any one of the first to seventh aspects, by that a plurality of housing movable portions are movably supported by the housing base portion.

As described above, the coaxial connector with a floating mechanism according to an aspect of the present invention is a coaxial connector including the plug and the socket that are connected to each other. The plug includes the plug-side center contact that is arranged at the center, the plug-side shell that is arranged outside the plug-side center contact, and the plug-side insulator that is interposed between the plug-side center contact and the plug-side shell. The socket includes the socket-side center contact that is arranged at the center, the socket-side shell that is arranged outside the socket-side center contact, and the housing that holds the socket-side center contact and the socket-side shell in a mutually insulated state. The housing includes the housing base portion that is fixed to the support member, and the housing movable portion that is radially movable over the plug-side end face of the housing base portion along with the socket-side center contact. The top side of the plug-side shell is fitted onto the housing movable portion. The socket-side shell integrally includes the shell contact plate portion that is exposed from the plug-side end face of the housing base portion. The end of the plug-side shell is configured to make contact with the shell contact plate portion. Even if the housing movable portion of the socket moves to correct a positional deviation in radial directions (x and y directions), no gap occurs between the plug-side shell and the socket-side shell therefore, whereby a high high-frequency characteristic and a high shielding characteristic can be maintained.

According to an aspect of the present invention, the contact plate escape groove is circumferentially formed in the housing movable portion. The shell contact plate portion is configured to be able to escape into the contact plate escape groove. The movement of the housing movable portion therefore will not be hampered even if the shell contact plate is provided.

According to an aspect of the present invention, the sliding contact portion of arc-like chamfered shape is formed on the end of the plug-side shell. The housing movable portion can thus move smoothly in the radial directions (x and y directions) with respect to the housing base portion even if the end of the plug-side shell is in contact with the shell contact plate portion.

According to an aspect of the present invention, the plug-side shell includes the shell main body that holds the plug-side insulator, the movable shell of cylindrical shape that is axially movably held on the socket side of the shell main body, and the biasing spring that biases the movable shell to the socket side. A positional deviation between the plug and the socket in the axial direction (z-axis direction) can thus be corrected to maintain a stable connection state between the plug and the socket. The plug-side shell can also be maintained in a stable contact state with respect to the shell contact plate portion. A high high-frequency characteristic and a high shielding characteristic can thus be obtained.

According to an aspect of the present invention, the housing includes the floating spring member that is fixed at one end to the housing base portion and at the other end to the housing movable portion. The floating spring member includes the support fixed portion that is fixed to the housing base portion, the floating fixed portion that is fixed to the housing movable portion, and the elastically-deformable swing spring portion that connects the support fixed portion and the floating fixed portion. The housing movable portion is movably supported by the housing base portion via the floating spring member. The portion to be interconnected with the plug and the portion constituting the floating mechanism can thus be integrally configured. This can miniaturize the connector and reduce the parts count.

According to an aspect of the present invention, the socket-side center contact includes the contact portion that moves together with the housing movable portion, and the substrate connection terminal that is connected to the mounting substrate. The contact portion is integrally supported by the floating fixed portion of the floating spring member. The substrate contact terminal is integrally supported with the support fixed portion. The socket-side center contact is integrated with the floating spring member. This can reduce the parts count and simplify the assembly operation. Since the socket-side center contact follows the movement of the housing movable portion, a deviation of the center axes within the connector can be prevented to suppress a drop in the high-frequency performance.

According to an aspect of the present invention, the socket-side shell includes the pair of elastic contact pieces that are opposed to each other at a distance in the direction crossing the direction from the support fixed portion to the floating fixed portion, the pair of elastic contact pieces being arranged outside the housing movable portion. This allows the movement of the housing movable portion and the socket-side center contact in the direction between the two elastic contact pieces, and can establish reliable connection with the plug-side shell.

According to the present invention, a plurality of housing movable portions are movably supported by the housing base portion. Such a configuration is applicable to a multiple coaxial connector.

DESCRIPTION OF EMBODIMENTS

Figure 1:
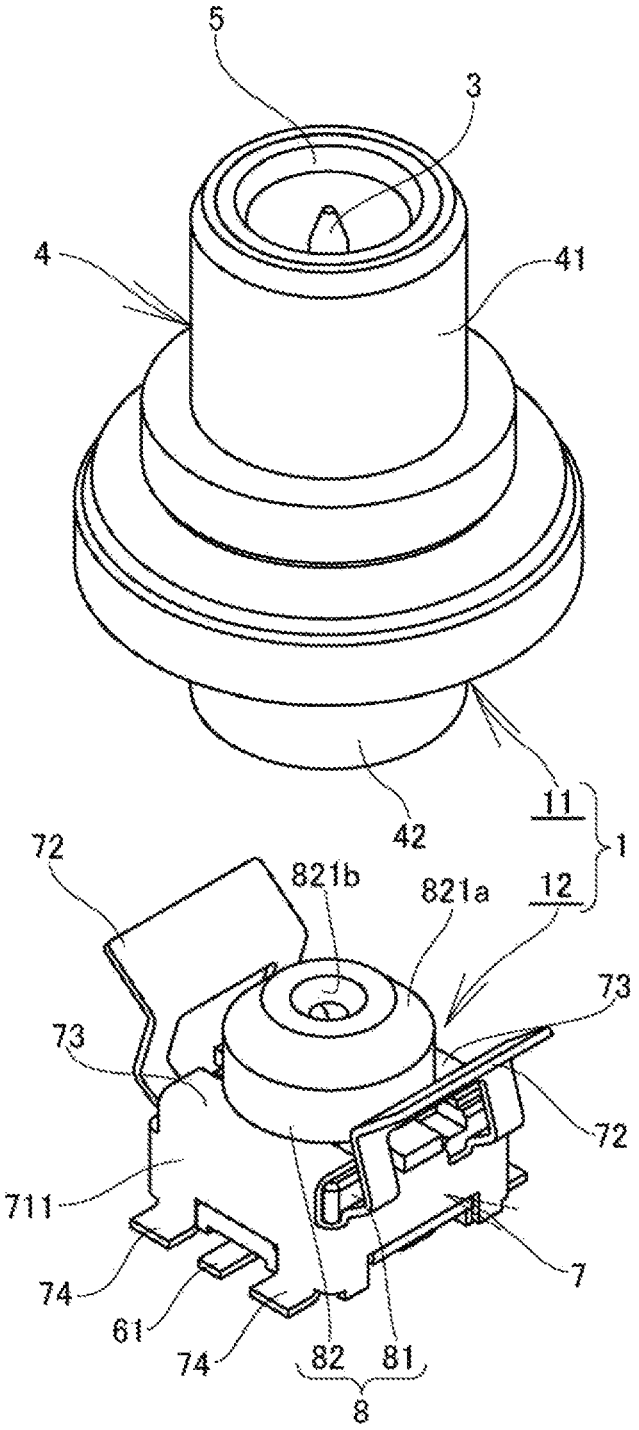
FIG. 1 is an exploded perspective view showing an example of a coaxial connector with a floating mechanism according to an embodiment of the present invention.

Next, an embodiment of the present invention will be described on the basis of an embodiment shown in FIGS. 1 to 12. In the diagrams, the reference numeral 1 represents a coaxial connector with a floating mechanism.

The coaxial connector 1 with a floating mechanism includes a plug 11 and a socket 12 which are connected to each other. The coaxial connector 1 with a floating mechanism is configured to be able to connect the plug 11 and the socket 12 while correcting positional deviations therebetween in radial directions (x- and y-axis directions) and an axial direction (z-axis direction) with the floating mechanism.

Figure 2A:
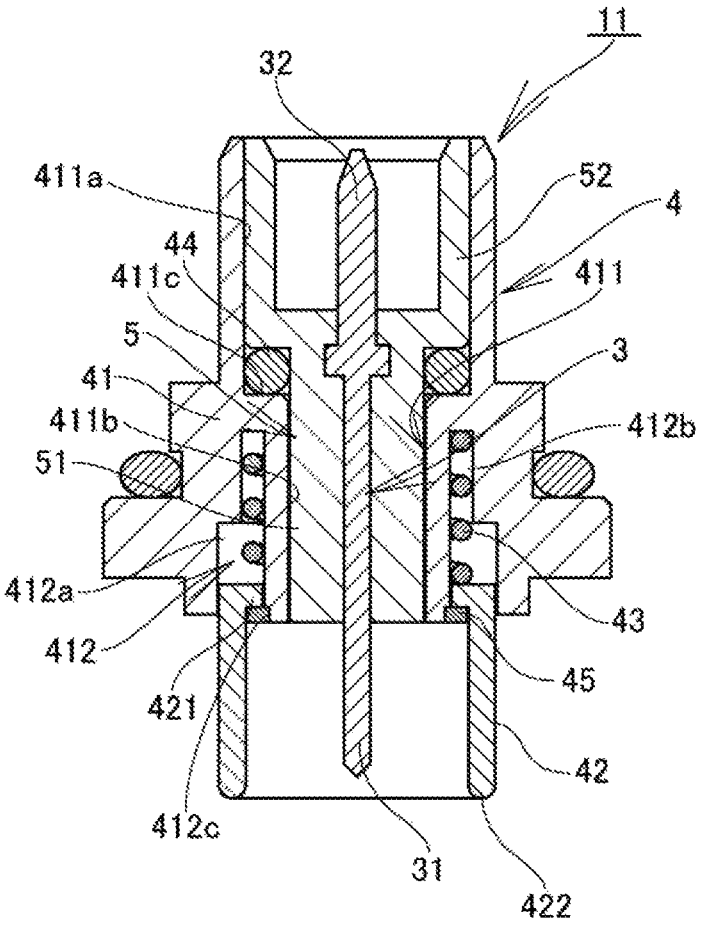
FIG. 2A is a longitudinal cross-sectional view showing the plug in FIG. 1.
Figure 2B:
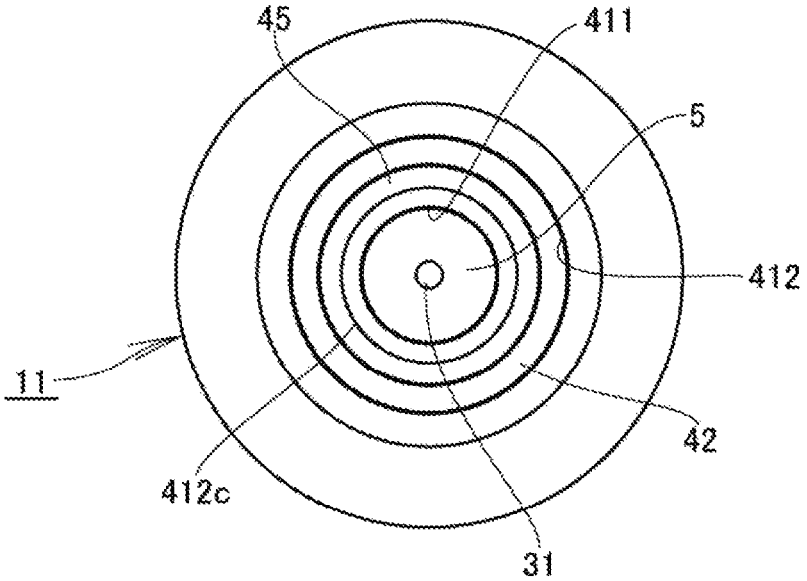
FIG. 2B is a bottom view of the plug in FIG. 1.
Figure 3:
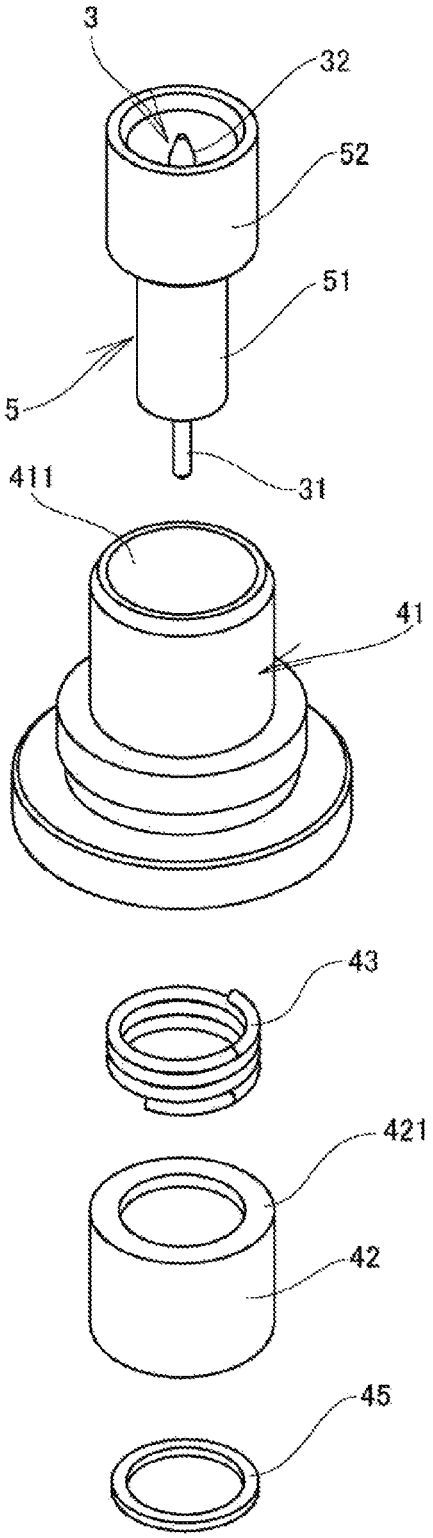
FIG. 3 is a reduced exploded perspective view of the plug.

As shown in FIGS. 2A, 2B, and 3, the plug 11 includes a plug-side center contact 3, a plug-side shell 4, and an insulating plug-side insulator 5. The plug-side center contact 3 is made of a conductive metal material and arranged at the center. The plug-side shell 4 is arranged outside the plug-side center contact 3. The plug-side insulator 5 is interposed between the plug-side center contact 3 and the plug-side shell 4. The plug-side insulator 5 and the plug-side center contact 3 are built in the plug-side shell 4.

The plug-side center contact 3 is formed in a wire shape made of a conductive metal material. One end of the plug-side center contact 3 forms a contact portion 31 to make contact with a socket-side center contact 6. The other end forms a terminal portion 32 to be connected to a coaxial cable or other electronic devices.

The plug-side insulator 5 is integrally molded of an insulating resin. The plug-side insulator 5 includes an insulator main body portion 51 of columnar shape and an expanded diameter cylinder portion 52 of cylindrical shape which protrudes from a rear end side of the insulator main body portion 51. The plug-side insulator 5 including the insulator main body portion 51 and the expanded diameter cylinder portion 52 has a stepped protruded shape.

The plug-side center contact 3 is embedded in the insulator main body portion 51 of the plug-side insulator 5, with both of its ends, i.e., the contact portion 31 and the terminal portion 32 protruded.

The expanded diameter cylinder portion 52 is formed in the shape of a closed-bottomed cylinder having an open top the outer diameter of which is greater than that of the insulator main body portion 51. The terminal portion 32 protrudes from the bottom portion to the interior of the expanded diameter cylinder portion 52.

The plug-side shell 4 includes a shell main body 41, a movable shell 42, and a biasing spring 43. The shell main body 41 holds the plug-side insulator 5. The movable shell 42 is axially movably supported on the plug 11 side of the shell main body 41. The biasing spring 43 biases the movable shell 42 in a protruding direction.

The movable shell 42 is formed in a cylindrical shape by pressing or casting a conductive metal material. A retaining flange 421 protruding inward is integrally formed on one opening portion of the movable shell 42.

A sliding contact portion 422 of arc-like chamfered shape is formed along the entire circumference of the socket 12 side end of the movable shell 42.

The shell main body 41 is casted in a conductive metal material. The shell main body 41 is formed in the shape of a cylinder having an insulator accommodation hole 411 for accommodating the plug-side insulator 5 in the center. A movable shell accommodation groove 412 of circular groove shape is formed in a thick portion outside the insulator accommodation hole 411 so as to be opened in the end face on the socket 12 side. The movable shell 42 is inserted into the movable shell accommodation groove 412 in an extendable and retractable manner.

The insulator accommodation hole 411 is formed in a stepped hole shape such that an expanded diameter portion 411*a* and a reduced diameter portion 411*b* having different inner diameters are continuously arranged to communicate with each other. The plug-side insulator 5 is inserted into the insulator accommodation hole 411 from a top opening (end opening on the side opposite from the socket 12). The end face of the expanded diameter cylinder portion 52 of the plug-side insulator 5 comes into contact with a step portion 411*c*, whereby the plug-side insulator 5 is held in the shell main body 41.

In the drawing, the reference numeral 44 represents a sealing member such as an O ring. The sealing member 44 seals a gap between the shell main body 41 and the plug-side insulator 5.

The movable shell accommodation groove 412 includes a sliding guide portion 412*a* of which the outer diameter is expanded to the shell side, and a spring holding portion 412*b* which communicates with the sliding guide portion 412*a*. The biasing spring 43 and the movable shell 42 are successively inserted into the movable shell accommodation groove 412 from the shell-side opening. The retaining flange 412 can move in the axial direction as guided by the sliding guide portion 412*a*.

A ring fitting portion 412*c* is circumferentially formed in the socket 12 side end of the inner diameter portion of the movable shell accommodation groove 412. A stopper ring 45 is fitted to the ring fitting portion 412*c*, so that the retaining flange 421 is stopped by the stopper ring 45.

The biasing spring 43 is a coil spring made of conductive metal. The biasing spring 43 is inserted into the spring holding portion 412*b* of the movable shell accommodation groove 412 and supported by the shell main body 41 to press the retaining flange 421. The biasing spring 43 thereby biases the movable shell 42 in the protruding direction.

In the plug-side shell 4, the movable shell 42 is accommodated in the movable shell accommodation groove 412. The outer peripheral surface or inner peripheral surface of the movable shell 42 is always in contact with the outer peripheral surface or inner peripheral surface of the movable shell accommodation groove 412. The movable shell 42 and the shell main body 41 are thus in a conducting state. The conducting state of the shell main body 41 and the movable shell 42 is also always maintained via the biasing spring 43.

Figure 4A:
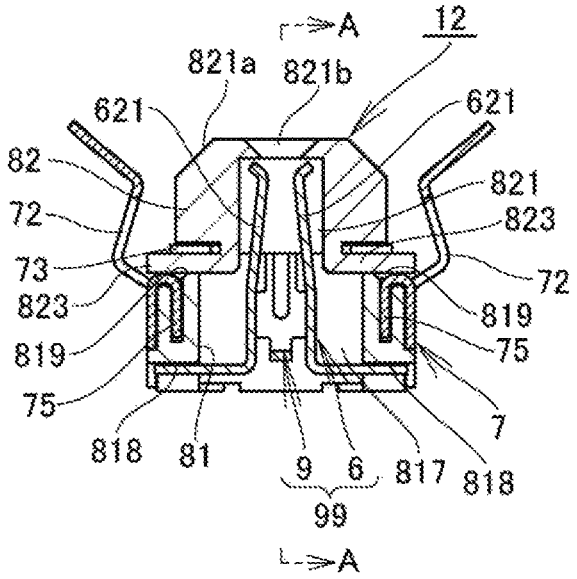
FIG. 4A is a longitudinal cross-sectional view of the socket in FIG. 1.
Figure 4B:
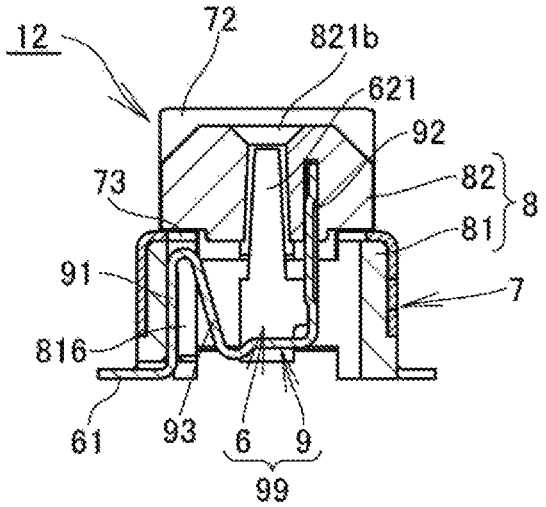
FIG. 4B is a cross-sectional view taken along the line A-A of the socket in FIG. 1.
Figure 5:
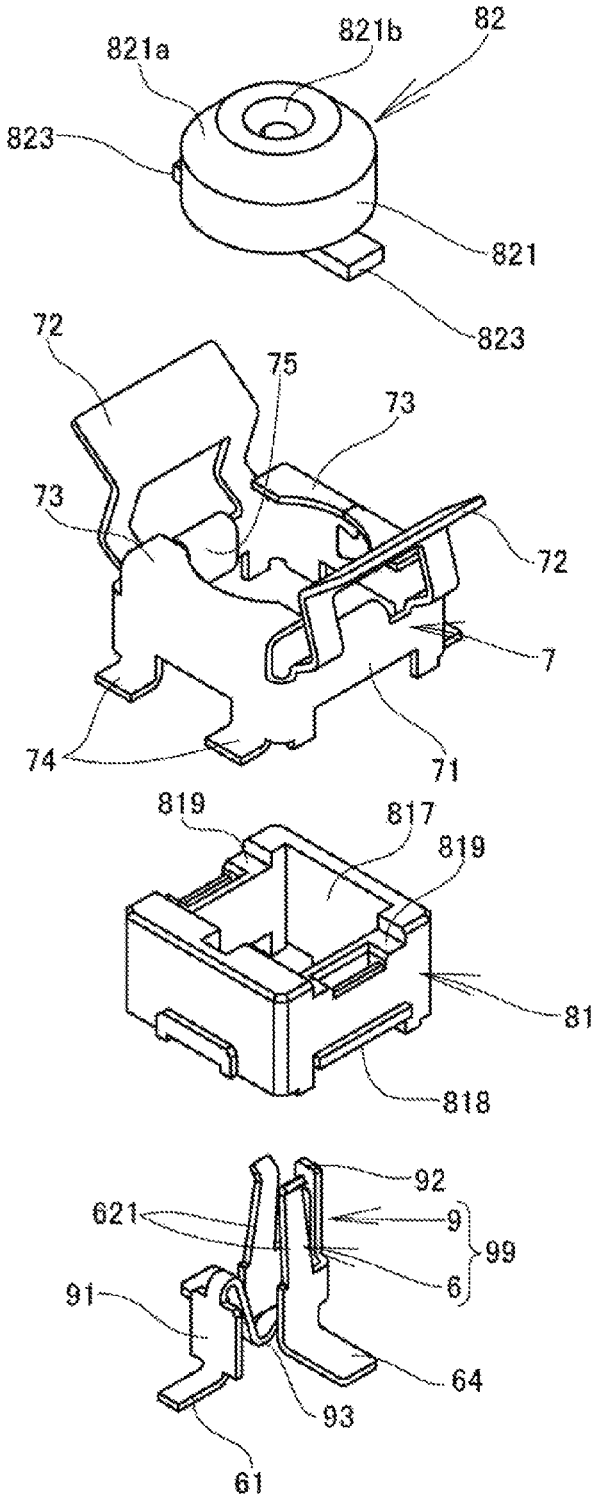
FIG. 5 is an exploded perspective view of the socket.
Figure 6A:
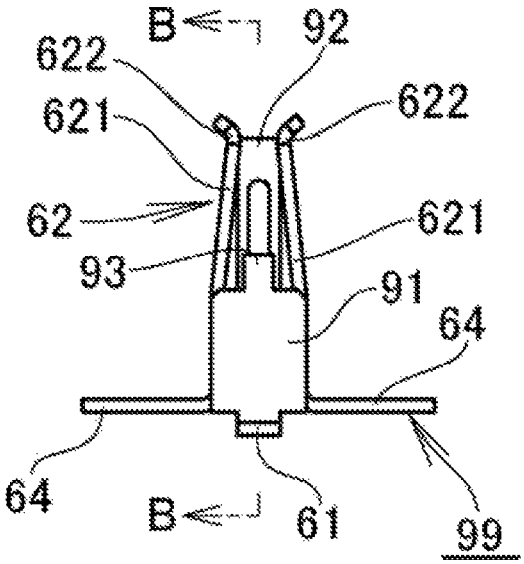
FIG. 6A is a front view showing a floating spring member of the foregoing socket.
Figure 6B:
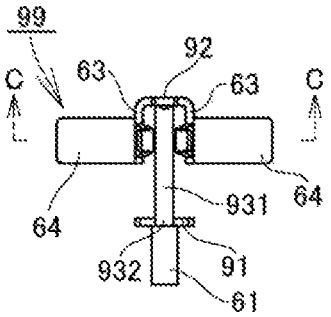
FIG. 6B is a plan view of the floating spring member.
Figure 6C:
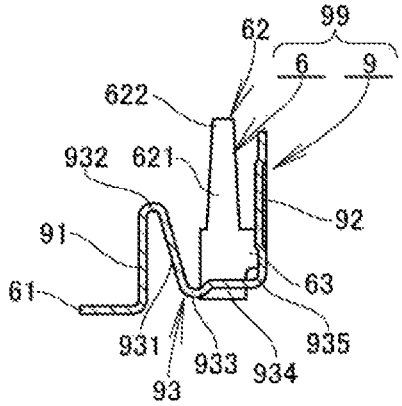
FIG. 6C is a cross-sectional view taken along the line B-B of the floating spring member.
Figure 6D:
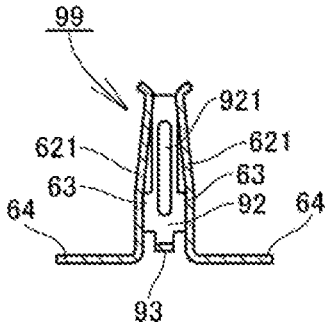
FIG. 6D is a cross-sectional view taken along the line C-C of the floating spring member.

As shown in FIGS. 4A, 4B, and 5, the socket 12 includes a socket-side center contact 6, a socket-side shell 7, and a housing 8. The socket-side center contact 6 is arranged at the center. The socket-side shell 7 is arranged outside the socket-side center contact 6. The housing 8 holds the socket-side center contact 6 and the socket-side shell 7 in a mutually insulated state. The socket 12 is configured to be engaged with the plug 11 so that their center contacts and shells are respectively connected to each other.

The housing 8 includes a housing base portion 81, a housing movable portion 82, and a floating spring member 9. The housing base portion 81 is fixed to a support member such as a substrate and a casing of an electronic device. The housing movable portion 82 is located on an end face of the housing base portion 81 on the plug 11 side, and can move with the socket-side center contact 6 with respect to the housing base portion 81. The floating spring member 9 is fixed at one end to the housing base portion 81 and at the other end to the housing movable portion 82. The housing movable portion 82 and the socket-side center contact 6 are movably supported by the housing base portion 81 via the floating spring member 9, whereby a floating mechanism is formed.

The socket-side center contact 6 and the floating spring member 9 are integrated into a floating spring member with a contact (hereinafter, referred to as an integral spring member) 99 which is made of a conductive metal plate member. The socket 12 uses the integral spring member 99 so that the socket-side center contact 6 can follow the movement of the housing movable portion 82.

As shown in FIGS. 6A to 6D, the integral spring member 99 is integrally formed by stamping and bending an elastic conductive metal plate member. The integral spring member 99 is configured such that the floating spring member 9 integrally supports the socket-side center contact 6 and the floating spring member 9 also serves as some of the components of the socket-side center contact 6.

The floating spring member 9 includes a support fixed portion 91, a floating fixed portion 92, and a swing spring portion 93. The support fixed portion 91 is fixed to the housing base portion 81. The floating fixed portion 92 is fixed to the housing movable portion 82. The swing spring portion 93 connects the support fixed portion 91 and the floating fixed portion 92 and is capable of elastic deformation. The support fixed portion 91 and the floating fixed portion 92 are arranged in parallel in front and behind at a distance therebetween. The elastic deformation of the swing spring portion 93 allows the floating fixed portion 92 to move back and forth and swing laterally with respect to the support fixed portion 91.

The support fixed portion 91 is formed in a rectangular shape. One end of the swing spring portion 93 is integrally supported on the top end of the support fixed portion 91. A substrate connection terminal strip 61 constituting the socket-side center contact 6 is horizontally extended from the bottom end of the support fixed portion 91.

The swing spring portion 93 integrally includes an elastic expansion and contraction portion 931 and elastic twist portions. The elastic expansion and contraction portion 931 can expand and contract in a direction from the support fixed portion 91 to the floating fixed portion 92, i.e., in a front-to-rear direction. The elastic twist portions can twist about an axis in the direction from the support fixed portion 91 to the floating fixed portion 92. The expansion and contraction of the elastic expansion and contraction portion 931 allow movement of the floating fixed portion 92 in the front-to-rear direction with respect to the support fixed portion 91. The twist of the elastic twist portions allows movement of the floating fixed portion 92 in the lateral direction with respect to the support fixed portion 91. The floating fixed portion 92 can return to the original position by elasticity.

The elastic expansion and contraction portion 931 is extended obliquely downward with its top end supported by the upper edge of the support fixed portion 91 via a folded portion 932 which is bent in an arc shape. A horizontally-extended impedance adjustment portion 934 is integrally supported on the bottom end of the elastic expansion and contraction portion 931 via a folded portion 933.

The bends in the two folded portions 932 and 933 allow the elastic expansion and contraction portion 931 to expand and contract in the direction from the support fixed portion 91 to the floating fixed portion 92, i.e., in the front-to-rear direction and return to the original position by elasticity.

The impedance adjustment portion 934 is formed in the shape of a horizontally-extended narrow plate. One end of the impedance adjustment unit 934 is supported by the elastic expansion and contraction portion 931 via the folded portion 933. The other end is integrally supported on the lower edge of the floating fixed portion 92 via a folded portion 935.

The plate width of the impedance adjustment portion 934 in the lateral direction can be changed at the time of press molding. The width of the impedance adjustment portion 934 can be appropriately changed to adjust the impedance of the socket-side center contact 6 integrated with the floating spring member 9 to an appropriate value.

The folded portions 932, 933, and 935 are formed to be narrower than the plate widths of the support fixed portion 91 and the floating fixed portion 92. The folded portions 932, 933, and 935 constitute the elastic twist portions of the swing spring portion 93.

More specifically, if the floating fixed portion 92 makes a relative lateral movement with respective to the support fixed portion 91, the folded portions 932, 933, and 935 twist about the axis in the direction from the support fixed portion 91 to the floating fixed portion 92 to allow the lateral movement. The floating fixed portion 92 can return to the original position by elasticity.

The floating fixed portion 92 is formed in a vertically-directed rectangular shape. A bulging portion 921 of vertical projection shape is integrally formed in the center of the floating fixed portion 92 so as to bulge toward the support fixed portion 91. Elastic sandwiching pieces 621 constituting a connection portion 62 of the socket-side center contact 6 are integrally supported on both lower sides of the floating fixed portion 92.

The socket-side center contact 6 includes the connection portion 62 to be connected with the plug-side center contact 3, and the substrate connection terminal strip 61 to be connected with a connection substrate. The connection portion 62 and the substrate connection terminal strip 61 are electrically connected via the floating spring member 9.

The connection portion 62 includes a pair of elastic sandwiching pieces 621 which are laterally opposed to each other. The two elastic sandwiching pieces 621 sandwich the contact portion 31 of the plug-side center contact 3 of pin shape to establish connection with the plug-side center contact 3.

The elastic sandwiching pieces 621 are formed in a vertically long strip shape. The lower side edges of the elastic sandwiching pieces 621 are integrally supported by support pieces 63 which are folded at right angles on the lower side edges of the floating fixed portion 92. The elastic sandwiching pieces 621 are arranged to be laterally opposed to each other between the support fixed portion 91 and the floating fixed portion 92.

The elastic sandwiching pieces 621 each have an inwardly-curved contact 622 at the top end. The plug-side center contact 3 is sandwiched between the mutually-opposed contacts 622.

Retaining guide pieces 64 extended horizontally outward are integrally supported on the bottom ends of the elastic sandwiching pieces 621. The retaining guide pieces 64 are stopped by the bottom end of the housing bottom portion 81 so as to be movable in the front-to-rear and lateral directions.

Figure 7A:
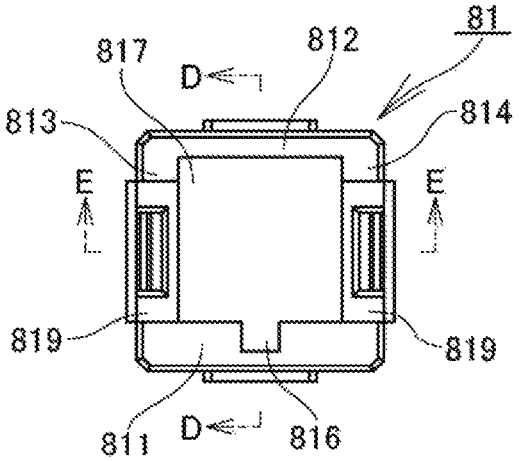
FIG. 7A is a plan view showing a housing base portion of the foregoing socket.
Figure 7B:
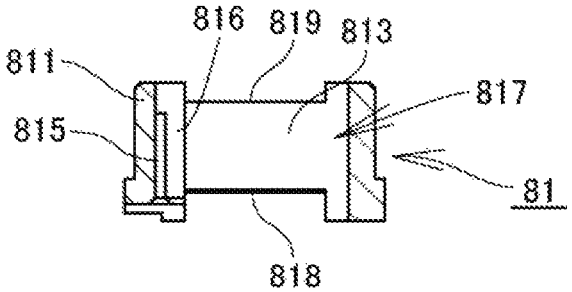
FIG. 7B is a cross-sectional view taken along the line D-D of the housing base portion.
Figure 7C:
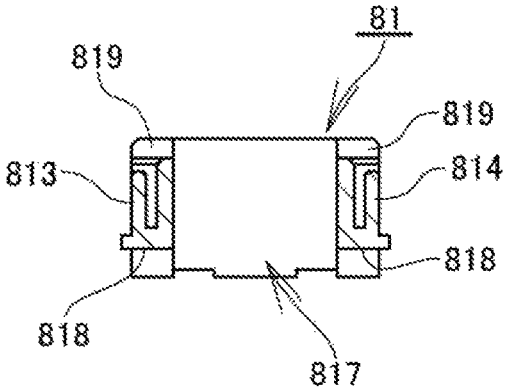
FIG. 7C is a cross-sectional view taken along the line E-E of the housing base portion.

As shown in FIGS. 7A to 7C, the housing base portion 81 is made of an insulating synthetic resin in the shape of a rectangular cylinder that is opened at the top and bottom and has front, rear, left, and right peripheral wall portions 811 to 814. The housing movable portion 82 is attached to the top side of the housing base portion 81. The integral spring member 99 is attached into the housing base portion 81 from the bottom side. The housing movable portion 82 and the housing base portion 81 are movably connected via the floating spring member 9.

A vertically-directed support fixed portion press-in portion 815 is formed in the front peripheral wall portion 811. The support fixed portion 91 of the floating spring member 9 is pressed into the support fixed portion press-in portion 815, whereby one end of the floating spring member 9, i.e., the support fixed portion 91 is fixed to the housing base portion 81.

The front peripheral wall portion 811 also has an escape groove 816 which is opened at the inner surface side of the support fixed portion press-in portion 815 and communicates with the support fixed portion press-in portion 815. This prevents the swing spring portion 93 from interfering with the peripheral wall portions 811 to 814.

Consequently, the lower parts of the floating fixed portion 92 and the two elastic sandwiching pieces 621 of the integral spring member 99 are supported by the housing 8 via the swing spring portion 93 and movably accommodated in a hollow portion 817. The upper parts of the floating fixed portion 92 and the two elastic sandwiching pieces 621 of the integral spring member 99 are protruded from the top opening of the hollow portion 817.

Lower guide grooves 818 of recessed shape are formed in the lower surfaces of the left and right peripheral wall portions 813 and 814 of the housing base portion 81. Upper guide grooves 819 of recessed shape are formed in the upper surfaces of the left and right peripheral wall portions 813 and 814 of the housing base portion 81. The retaining guide pieces 64 of the integral spring member 99 are inserted into the lower guide grooves 818. The retaining guide pieces 64 are guided by the guide grooves 818 and stopped by the upper edges of the guide grooves 818, whereby the integral spring member 99 is retained.

The socket-side shell 7 made of a conductive metal material is attached to outside the housing base portion 81.

The housing base portion 81 is fixed to a support member such as a mounting substrate via the socket-side shell 7.

Figure 8A:
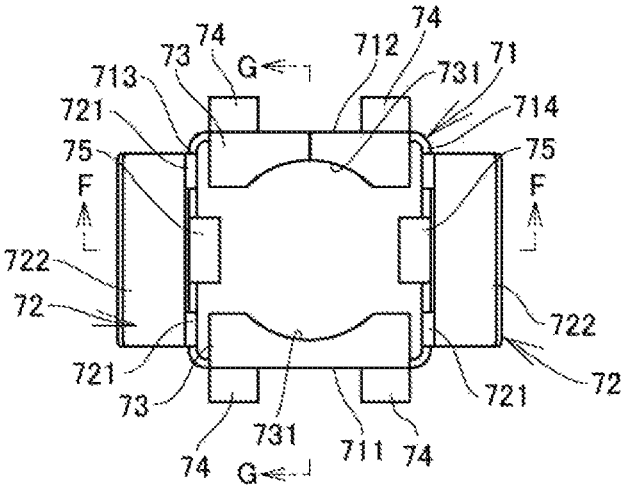
FIG. 8A is a plan view showing a socket-side shell of the foregoing socket.
Figure 8B:
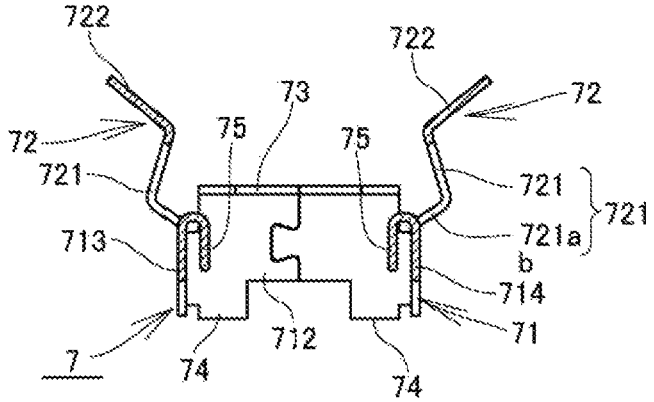
FIG. 8B is a cross-sectional view taken along the line F-F of the socket-side shell.
Figure 8C:
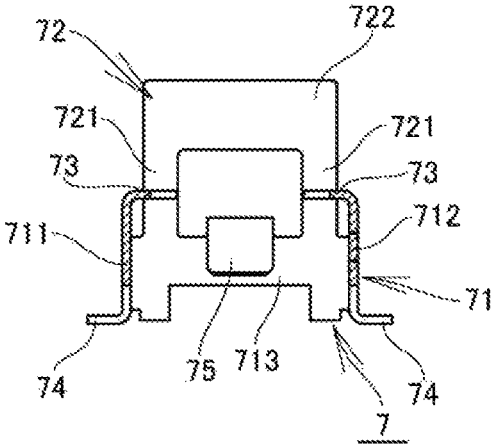
FIG. 8C is a cross-sectional view taken along the line G-G of the socket-side shell.
Figure 9A:
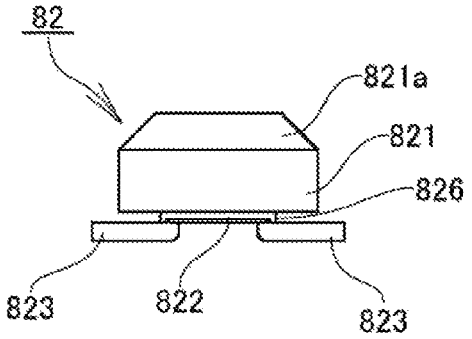
FIG. 9A is a front view showing a housing movable portion of the foregoing socket.
Figure 9B:
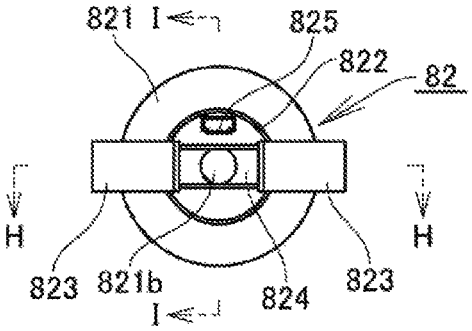
FIG. 9B is a bottom view of the housing movable portion.
Figure 9C:
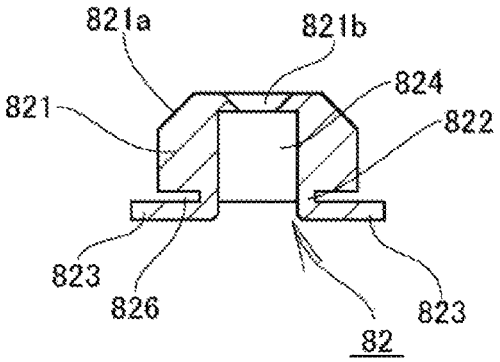
FIG. 9C is a cross-sectional view taken along the line H-H of the housing movable portion.
Figure 9D:
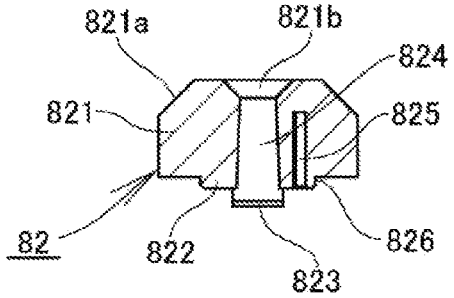
FIG. 9D is a cross-sectional view taken along the line I-I of the housing movable portion.

As shown in FIGS. 8A to 8C, the socket side shell 7 is integrally formed by pressing an elastic conductive metal plate member. The socket-side shell 7 includes a cylindrical portion 71 of rectangular cylindrical shape, a pair of elastic contact piece portions 72, and shell contact plate portions 73. The cylindrical portion 71 surrounds the outer periphery of the housing base portion 81. The elastic contact piece portions 72 are integrally supported by left and right side plates 713 and 714 of the cylindrical portion 71, respectively. The shell contact plate portions 73 are integrally supported on the top edges of front and rear side plates 711 and 712 of the cylindrical portion 71.

Substrate connection portions 74 protruding outward are integrally formed on the lower edges of the front and rear side plates of the socket-side shell 7. Fixed locking portions 75 of inwardly folded shape are integrally formed on the top edges of the left and right side plates. The fixed locking portions 75 are engaged with the left and right peripheral wall portions 813 and 814 of the housing bottom portion 81, and the substrate connection portions 74 are soldered to a pattern on the mounting substrate. The housing base portion 81 is thereby fixed to the mounting substrate which is the support member, and the socket-side shell 7 is electrically connected to the mounting substrate.

The elastic contact piece portions 72 each include a pair of elastic support pieces 721 and a contact piece 722. Bottom ends of the elastic support pieces 721 are integrally supported by the top edge of the left or right side plate 713 or 714. The contact piece 722 is shaped to bridge the two elastic support pieces 721. When seen in a side view, the contact piece 722 and the two elastic support pieces 721 form a gate shape.

Each elastic support piece 721 includes a spring base portion 721*a* and a support spring portion 721*b*. The spring base portion 721*a* is extended obliquely outward from the top edge of the left or right side plate portion. The support spring portion 721*b* is extended obliquely inward from the end of the spring base portion 721*a*. An end of the contact piece 722 is integrally supported on the end of the support spring portion 721*b*.

The contact piece 722 is formed in an inwardly-curved L shape or inverted L shape. The contact piece 722 is configured so that the apex of the curved portion makes contact with the outer peripheral surface of the plug-side shell 4 (movable shell 42).

The shell contact plate portions 73 are formed in a narrow plate shape, bent inward from the top edges of the front and rear side plates. The shell contact plate portions 73 are configured to be exposed from the end face of the housing base portion 81 on the plug 11 side when the socket-side shell 7 is attached to the housing base portion 81.

Arc-shaped notches 731 are formed in the center portions of the inner rims of the shell contact plate portions 73 so as not to interfere with the movement of the housing movable portion 82.

As shown FIGS. 9A to 9D, the housing movable portion 82 is integrally molded of an insulating synthetic resin, and includes a movable main body portion 821 of flat columnar shape, a protruded portion 822 of columnar shape, and sliding portions 823. The protruded portion 822 protrudes from the bottom end of the movable main body portion 821. The sliding portions 823 are extended laterally outward from the bottom end of the protruded portion 822. A contact accommodation portion 824 of rectangular hole shape, opened at the bottom side, is formed through the movable main body portion 821 and the protruded portion 822.

The housing movable portion 82 has a fixed portion press-in hole 825 which is formed in parallel with the contact accommodation portion 824 and opened at the bottom. If the housing movable portion 82 is attached to the top surface part of the housing base portion 81, the floating fixed portion 92 protruding from the top end of the housing base portion 81 is pressed into the fixed portion press-in hole 825. In addition, the contact portion 62 of the socket-side center contact 6, i.e., the upper parts of the two elastic sandwiching pieces 621 are accommodated in the contact accommodation portion 824.

A guide surface portion 821*a* of tapered shape, of which the diameter decreases upward, is formed on the outer peripheral part of the upper end of the movable main body portion 821. The movable main body portion 821 also has a contact through hole 821*b* which is opened in the top end and communicates with the contact accommodation portion 824. The plug-side center contact 3 of pin shape is inserted into the housing 8 through the contact through hole 821*b*. The movable shell 42 of the plug-side shell 4 is guided by the guide surface portion 821*a* and fitted onto the housing movable portion 82.

The opening rim of the contact through hole 821*b* is formed in a tapered shape to decrease in diameter downward so that the plug-side center contact 3 is guided toward the center of the hole.

The protruded portion 822 is formed in the shape of a flat circular column having an outer diameter smaller than that of the movable main body portion 821. A contact plate escape groove 826 is circumferentially formed between the movable main body portion 821 and the sliding portions 823, i.e., outside the protruded portion 822 so that the shell contact plate portions 73 can escape into the contact plate escape groove 826.

The sliding portions 823 are passed through the upper guide grooves 819 formed in the upper ends of the left and right peripheral wall portions 813 and 814 of the housing base portion 81. The sliding portions 823 are guided by the inner edges of the upper guide grooves 819 so that the housing movable portion 82 can move over the plug-side end face of the housing base portion 81.

In the coaxial connector 1 with a floating mechanism configured thus, when the plug 11 and the socket 12 are mutually connected, the housing movable portion 82 is movably supported by the housing base portion 81 via the floating spring member 9 and moves with the socket-side center contact 6. Even if there is an axial misalignment with respect to the plug 11 in any of the front, rear, right, and left directions (x and y directions) at the time of mutual connection, the axial misalignment can thus be automatically adjusted to provide a stable connection state.

In the coaxial connector 1 with a floating mechanism, the socket 12 includes the shell contact plate portions 73 which are exposed from the end face of the housing base portion 81 on the plug 11 side. The end of the plug-side shell 4 is put into contact with the shell contact plate portions 73. This can provide a continuous shielding effect.

In the coaxial connector 1 with a floating mechanism, the plug-side shell 4 includes the movable shell 44 which is extendable and retractable from/into the end face of the shell main body 41 on the socket 12 side, and the biasing spring 43 which biases the movable shell 42. This can absorb a positional deviation occurring between the plug 11 and the socket 12 in the axial direction (z-axis direction) to always maintain the end of the plug-side shell 4 in contact with the shell contact plate portions 73. The plug-side shell 4 and the socket-side shell 7 can thus be connected without a gap in the axial direction, whereby a high shielding effect is provided.

Specifically, when the plug 11 and the socket 12 are connected, the movable shell 42 is biased by the biasing spring 43 and protruded from the plug-side end face of the shell main body 41. The movable shell 42 therefore fits onto the housing movable portion 82 and makes contact with the elastic contact piece portions 72 of the socket-side shell 7. The lower end of the movable shell 42 comes into contact with the shell contact plate portions 73 exposed from the plug-side end face of the housing base portion. The two shells 4 and 7 are thereby connected to each other.

If the movable shell 42 is fitted to the housing movable portion 82, the plug-side center contact 3 is inserted into the housing movable portion 82 through the contact through hole 821*b*, and the plug-side center contact 3 is connected with the socket-side center contact 6.

Figure 10A:
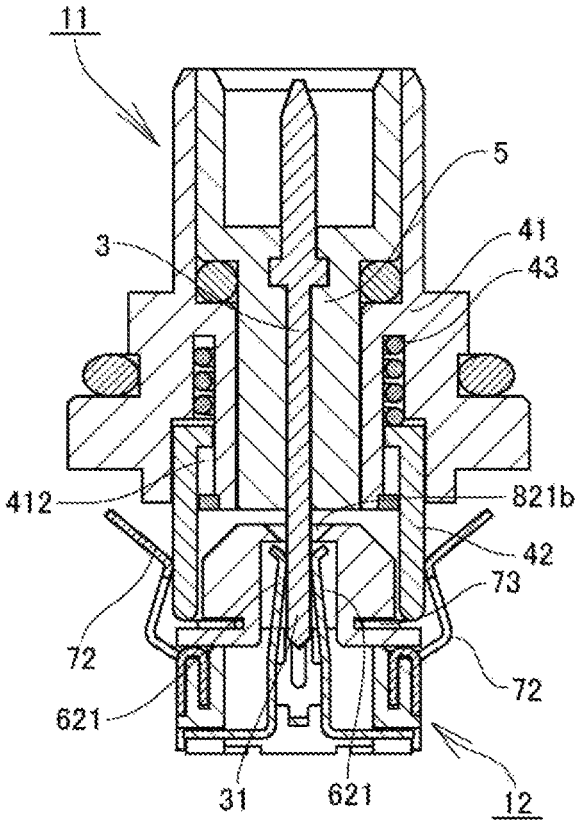
FIG. 10A is a longitudinal cross-sectional view for describing an operation of the coaxial connector with a floating mechanism according to an embodiment of the present invention, showing a state in which a plug-to-socket distance is small.
Figure 10B:
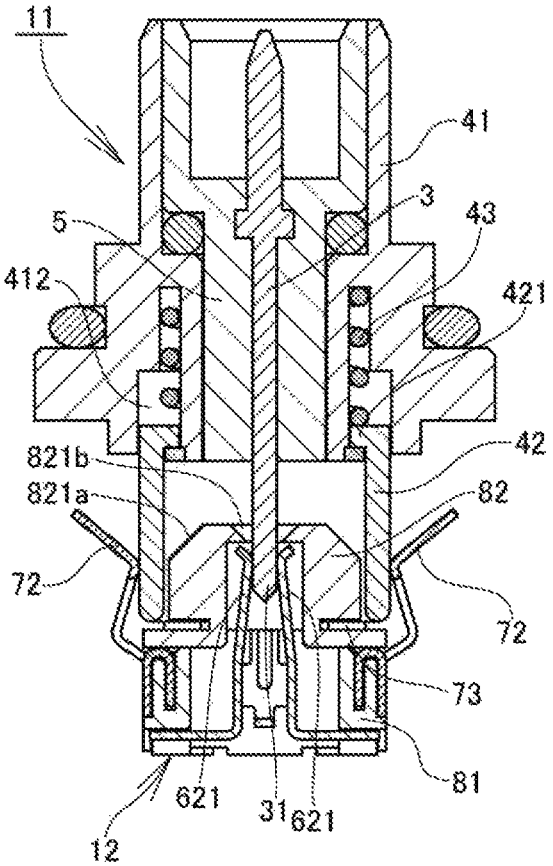
FIG. 10B is a longitudinal cross-sectional view for describing an operation of the coaxial connector with a floating mechanism according to an embodiment of the present invention, showing a state where the plug-to-socket distance is large.
Figure 11A:
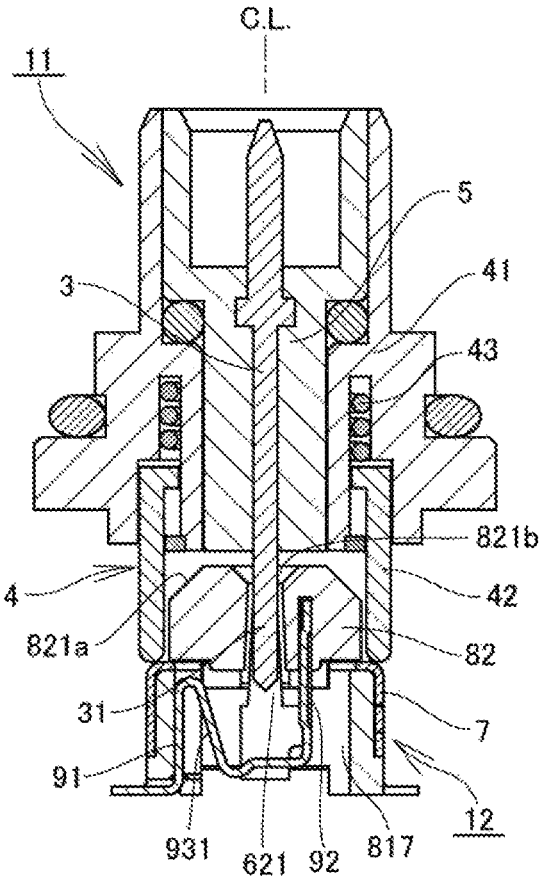
FIG. 11A is a longitudinal cross-sectional view for describing an operation of the coaxial connector with a floating mechanism according to an embodiment of the present invention, showing a state in which there is no axial misalignment.

The movable shell 42 in the state shown in FIG. 10B is then pressed in against the spring pressure of the biasing spring 43. As shown in FIG. 11A, the plug 11 and the socket 12 are thereby connected while absorbing a positional deviation in the axial direction (z-axis direction).

In other words, the coaxial connector 1 with a floating mechanism is configured to allow a positional deviation in the axial direction (z-axis direction) as much as the stroke of the movable shell 42 with respect to the shell main body 41.

Figure 11B:
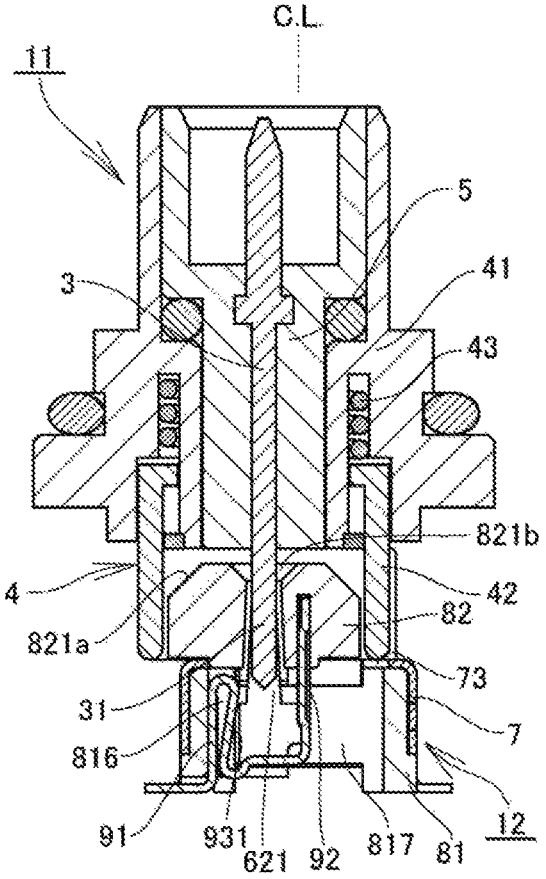
FIG. 11B is a longitudinal cross-sectional view for describing an operation of the coaxial connector with a floating mechanism according to an embodiment of the present invention, showing a state where there is an axial misalignment in a front-to-rear direction (x-axis direction).

FIG. 11A shows a case in which there is no positional deviation in the front-to-rear direction when the plug 11 and the socket 12 are connected. FIG. 11B shows a case in which there is a positional deviation between the plug 11 and the socket 12 in the front-to-rear direction. In the case shown in FIG. 11B, the housing movable portion 82 and the plug 11 are guided by the guide surface portion 821*a* of the housing movable portion 82 toward mutual fitting. The elastic expansion and contraction portion 931 of the swing spring portion 93 bends and contracts in the front-to-rear direction to allow a movement of the housing movable portion 82 and the contact portion of the socket-side center contact 6 with respect to the housing base portion 81 in the front-to-rear direction. The plug-side center contact 3 and the socket-side center contact 6 are thus connected to each other.

Here, the plug-side shell 4, or equivalently, the movable shell 42 moves in the front-to-rear direction while being fitted onto the housing movable portion 82 and sandwiched between the two elastic contact piece portions 72. In addition, the lower end of the movable shell 42 slides over the shell contact plate portions 73. The movable shell 42 is thus stably connected with the socket-side shell 7.

If the plug 11 is detached, the bent elastic expansion and contraction portion 931 is elastically restored, and the housing movable portion 82 returns to the center position on the housing base portion 81 according to the deformation of the switch spring portion 93.

Figure 12A:
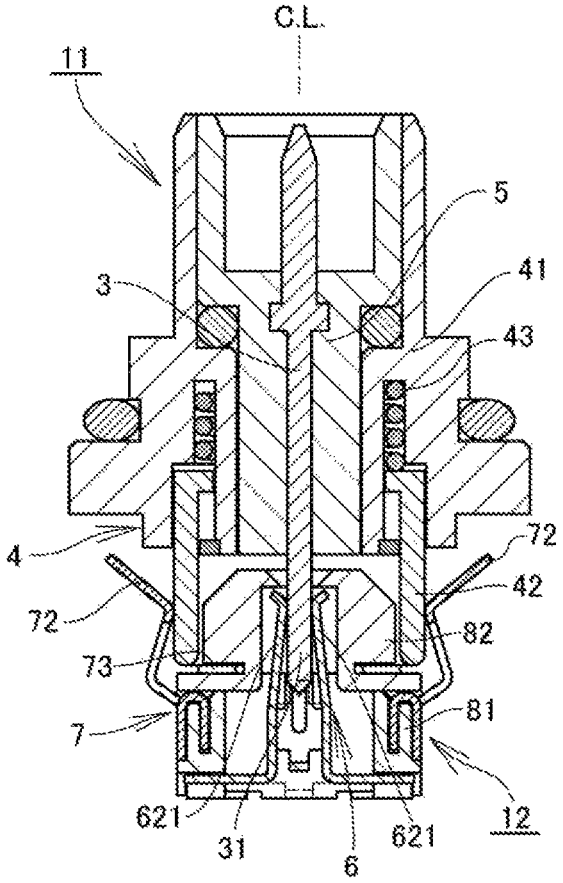
FIG. 12A is a longitudinal cross-sectional view for describing an operation of the coaxial connector with a floating mechanism according to an embodiment of the present invention, showing a state where there is no axial misalignment.
Figure 12B:
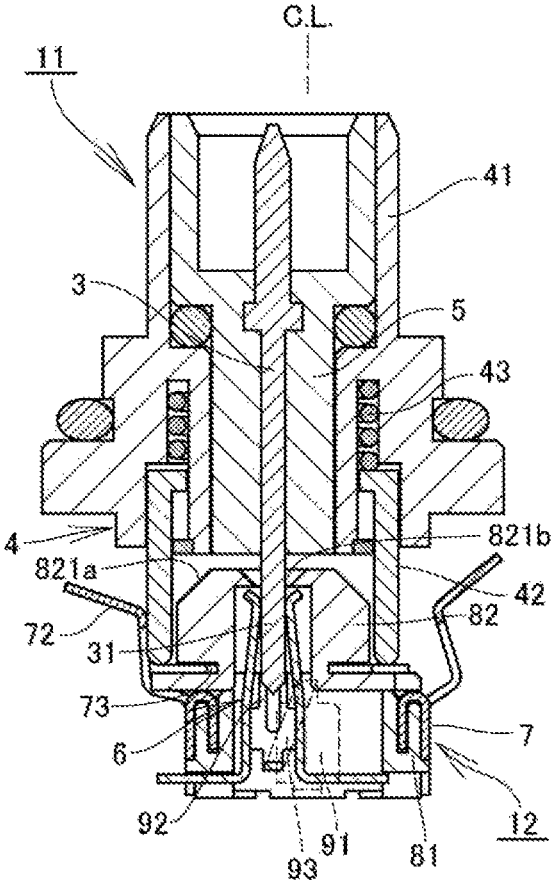
FIG. 12B is a longitudinal cross-sectional view for describing an operation of the coaxial connector with a floating mechanism according to an embodiment of the present invention, showing a state where there is an axial misalignment in a lateral direction (y-axis direction).

FIG. 12A shows a case in which there is no axial misalignment in the lateral direction. FIG. 12B shows a case in which there is an axial misalignment in the lateral direction. In the case shown in FIG. 12B, the housing movable portion 82 and the plug 11 are guided by the guide surface portion 821*a* of the housing moving portion 82 toward mutual fitting. The elastic twist portions 932, 933, and 935 of the swing spring portion 93 twist about the front-to-rear axis to allow a lateral movement of the housing movable portion 82 and the connection portion 62 of the socket-side center contact 6 with respect to the housing base portion 81. The plug-side center contact 3 and the socket-side center contact 6 are thus connected to each other.

Here, the plug-side shell 4 is pressed against either one of the elastic contact piece portions 72 while being fitted onto the housing movable portion 82. In addition, the lower end of the movable shell 42 slides over the shell contact plate portions 73. The plug-side shell 4 is thus stably connected with the socket-side shell 7.

If the plug 11 is detached, the bent elastic expansion and contraction portion 931 is elastically restored, and the housing movable portion 82 returns to the center position on the housing base portion 81 according to the deformation of the switch spring portion 93.

As described above, in the coaxial connector 1 with a floating mechanism according to an embodiment of the present invention, a positional deviation in the axial direction (z-axis direction) can be allowed by the expansion and contraction of the movable shell 42 of the plug 11. A positional deviation in the radial directions (x- and y-axis directions), i.e., to the front, rear, left, and right can be allowed in a composite manner. Specifically, a positional deviation in the front-to-rear direction can be allowed by the elastic expansion and contraction portion 931. A positional deviation in the lateral direction can be allowed by the elastic twist portions 932, 933, and 935. The coaxial connector 1 with a floating mechanism is thus capable of floating in any direction.

Since the integral spring member 99 is used and the contact portion 62 of the socket-side center contact 6 is integrally supported by the floating fixed portion 92, the center position of the socket-side center contact 6 moves with the floating operation to follow the center position of the plug-side center contact 3. This can prevent the misalignment of the center axes within the connector. Since the housing movable portion 81 moves horizontally with respect to the housing base portion 81, the movable shell 42 is prevented from lifting off the shell contact plate portions 73. This can maintain high high-frequency performance and high shielding performance.

The foregoing embodiment has described an example where the support member that supports the housing 8 is configured as a mounting substrate built in an electronic component. However, the support member is not limited thereto. For example, the casing of an electronic device may be used as the support member. The housing 8 may be connected to a coaxial cable, and the coaxial cable may be used as the support member.

The coaxial connector 1 with a floating mechanism according to an embodiment of the present invention may be applied to a multiple coaxial connector in which a plurality of housing movable portions 82 are movably connected onto the housing base portion 81.

REFERENCE SIGNS LIST

1 coaxial connector with floating mechanism
11 plug
12 socket
3 plug-side center contact
31 contact portion
32 terminal portion
4 plug-side shell
41 shell main body
411 insulator accommodation hole
412 movable shell accommodation groove
42 movable shell
43 biasing spring

44 sealing member
5 plug-side insulator
51 insulator main body portion
52 expanded diameter cylinder portion
6 socket-side center contact
61 substrate connection terminal strip
62 connection portion
621 elastic sandwiching piece
622 contact
63 support piece
64 retaining guide piece
7 socket-side shell
71 cylindrical portion
72 elastic contact piece portion
721 elastic support piece
722 contact piece
73 shell contact plate portion
74 substrate connection portion
75 fixed locking portion
8 housing
81 housing base portion
811 to 814 peripheral wall portion
815 support fixed portion press-in portion
816 escape groove
817 hollow portion
818 lower guide groove
819 upper guide groove
82 housing movable portion
821 movable main body portion
822 protruded portion
823 sliding portion
824 contact accommodation portion
825 fixed portion press-in hole
9 floating spring member
91 support fixed portion
92 floating fixed portion
921 bulging portion
93 swing spring portion
931 elastic expansion and contraction portion
932 folded portion
933 folded portion
934 impedance adjustment portion
935 folded portion
99 floating spring member with a contact (integral spring member)

The invention claimed is:

1. An electrical coaxial connector with a floating mechanism, including a plug and a socket to be connected to each other, the plug including a plug-side center contact that is arranged at a center, a plug-side shell that is arranged outside the plug-side center contact, and a plug-side insulator that is interposed between the plug-side center contact and the plug-side shell, the socket including a conductive metal plate member having a socket-side center contact that is arranged at a center, a socket-side shell that is arranged outside the socket-side center contact, and a housing that holds the socket-side center contact, and the socket-side shell holds the housing in a mutually insulated state, the housing including a housing base portion that is adapted to be fixed to a substrate or device, and a housing movable portion that is radially movable transversely over a plug-side end face of the housing base portion along with the socket-side center contact, a top side of the plug-side shell being fitted onto the housing movable portion, wherein the socket-side shell integrally includes a shell contact plate portion that is exposed from the plug-side end face of the housing base portion, and an end of the plug-side shell is configured to make contact with the shell contact plate portion, the conductive metal plate member includes a floating spring member that is fixed at one end to the housing base portion and at the other end to the housing movable portion;

the floating spring member includes a support fixed portion that is fixed to the housing base portion, a floating fixed portion that is fixed to the housing movable portion, and an elastically-deformable swing spring portion that connects the support fixed portion and the floating fixed portion, and the housing movable portion is movably supported by the housing base portion via the floating spring member, and a contact plate escape groove is circumferentially formed in the housing movable portion, and the shell contact plate portion is configured to be able to escape into the contact plate escape groove.

2. The electrical coaxial connector with a floating mechanism according to claim 1, wherein a sliding contact portion of arc-like chamfered shape is formed on an end of the plug-side shell.

3. The electrical coaxial connector with a floating mechanism according to claim 1, wherein the plug-side shell includes a shell main body that holds the plug-side insulator, a movable shell of cylindrical shape that is axially movably held on a socket side of the shell main body, and a biasing spring that biases the movable shell to the socket side.

4. The electrical coaxial connector with a floating mechanism according to claim 1, wherein:

the socket-side center contact includes a contact portion that moves together with the housing movable portion, and a substrate connection terminal that is connected to a mounting substrate;

the contact portion is integrally supported by the floating fixed portion of the floating spring member;

the substrate connection terminal is integrally supported with the support fixed portion; and the socket-side center contact is integrated with the floating spring member.

5. The electrical coaxial connector with a floating mechanism according to claim 1, wherein the socket-side shell includes a pair of elastic contact pieces that are opposed to each other at a distance in a direction crossing a direction from the support fixed portion to the floating fixed portion, the pair of elastic contact pieces being arranged outside the housing movable portion.

6. An electrical coaxial connector with a floating mechanism, including a plug and a socket to be connected to each other, the plug including a plug-side center contact that is arranged at a center, a plug-side shell that is arranged outside the plug-side center contact, and a plug-side insulator that is interposed between the plug-side center contact and the plug-side shell, the socket including a conductive metal plate member having a socket-side center contact that is arranged at a center, a socket-side shell that is arranged outside the socket-side center contact, and a housing that holds the socket-side center contact, and the socket-side shell holds the housing in a mutually insulated state, the housing including a housing base portion that is adapted to be fixed to a substrate or device, and a housing movable portion that is radially movable transversely over a plug-side end face of the housing base portion along with the socket-side center contact, a top side of the plug-side shell being fitted onto the housing movable portion, wherein the socket-side shell integrally includes a shell contact plate portion that is exposed from the plug-side end face of the housing base portion, and an end of the plug-side shell is configured to make contact with the shell contact plate portion, and a contact plate escape groove is circumferentially formed in the housing movable portion, and the shell contact plate portion is configured to be able to escape into the contact plate escape groove.

* * * * *